US006223977B1

(12) United States Patent
Hill

(10) Patent No.: US 6,223,977 B1
(45) Date of Patent: May 1, 2001

(54) EASY OPEN ENVELOPE

(75) Inventor: Maurice Hill, Kenosha, WI (US)

(73) Assignee: Westvaco Corporation, New York, NY (US)

( * ) Notice: Subject to any disclaimer, the term of this patent is extended or adjusted under 35 U.S.C. 154(b) by 0 days.

(21) Appl. No.: 09/324,594

(22) Filed: Jun. 3, 1999

(51) Int. Cl.[7] ..... B65D 27/34
(52) U.S. Cl. ..... 229/70; 229/313
(58) Field of Search ..... 229/70, 313, 316; 462/64, 65

(56) References Cited

U.S. PATENT DOCUMENTS

| | | | |
|---|---|---|---|
| 2,112,227 | 3/1938 | Berkowitz | 229/70 |
| 2,859,907 | 11/1958 | McFarland | 229/85 |
| 3,141,603 | 7/1964 | Whitman | 229/70 |
| 3,314,592 | 4/1967 | Streich | 229/313 |
| 3,318,510 | 5/1967 | Quarles, III et al. | 229/85 |
| 3,406,894 | 10/1968 | Settle | 229/70 |
| 3,460,743 | 8/1969 | Burnett | 229/70 |
| 3,650,463 | 3/1972 | Christiansen et al. | 229/313 |
| 3,652,008 | 3/1972 | Grotefend | 229/313 |
| 4,470,511 | 9/1984 | Meeker et al. | 229/313 |
| 4,566,627 | 1/1986 | Gendron | 229/81 |
| 5,967,403 | 10/1999 | Kranz | 229/70 |

FOREIGN PATENT DOCUMENTS

| | | | |
|---|---|---|---|
| 159599 | 3/1903 | (DE) | 229/313 |

*Primary Examiner*—Stephen P. Garbe
(74) *Attorney, Agent, or Firm*—J.R. McDaniel; R. L. Schmalz; L. C. Hall

(57) ABSTRACT

The envelope of the present invention is prepared from a single blank of material to include easy opening means and security features for tamper evident delivery of credit cards, debit cards and other sensitive material. The envelope structure includes a bangtail flap foldably attached to the rear panel of the envelope and folded inside the envelope, a pair of perforated lines located on each side of the rear panel for providing access to the inside bangtail flap, and a separate opening means for the closure flap.

3 Claims, 2 Drawing Sheets

EASY OPEN ENVELOPE

BACKGROUND OF INVENTION

The present invention relates generally to an envelope structure for securely sending credit cards, debit cards and other sensitive material through the mail. In particular the present invention relates to an envelope structure which includes tamper evident indicators for determining whether or not the mailing has been tampered with.

Various designs have been proposed in the past for making envelopes tamper evident. Typical of these designs is the construction shown in U.S. Pat. No. 4,566,627, owned by the present assignee herein. It is also possible to provide tamper evidence in an envelope construction with the use of special adhesives that bond closure flaps in such a way that the closure flaps cannot be opened without producing fiber tear. However, even when such adhesives are used, it is also desirable to incorporate into the envelope additional tamper evident features to maintain the security of the enclosed materials. It is an object of the present invention to satisfy these and other needs with the use of unique opening features that also serve as tamper evident indicators.

SUMMARY OF INVENTION

The present invention is directed to a novel envelope construction which includes unique opening features that also serve as tamper evident indicators. The envelope is primarily intended for use in securely mailing credit cards, debit cards and the like. In this regard, the envelope structure includes conventional features such as a front panel, a top closure flap foldably attached to one edge of the front panel and a rear panel foldably attached to the opposite edge of the front panel. In addition, as is conventional, a pair of side closure flaps are foldably attached to the side edges of the front or rear panel.

In addition to the above, an extra flap commonly referred to in the industry as a "bangtail flap" is foldably attached to the rear panel of the envelope. The credit cards may be releasibly attached to the bangtail flap before the flap is folded inside the envelope, or the credit cards may be attached to an insert that is included in the envelope. Conventional bangtail flaps are normally left outside the envelope structure and in the past have only been used to print advertising or promotional matter. These flaps are conventionally attached to the rear panel of a return envelope by a perforated line for easy removal before the return mailing. In the present invention, the bangtail flap may be used in its conventional fashion for printing advertising matter, or used as a support for the credit cards and folded inside the envelope. If desired, the bangtail flap may be foldably attached to the rear panel along a perforated line for easy detachability.

The opening means/tamper indicators for the envelope of the present invention include a tear strip formed in the top closure flap, and a pair of perforated tear lines applied to the rear panel. Removable tear strips in closure flaps are well known in the art as shown for example in U.S. Pat. Nos. 2,859,907 and 3,318,510. However, as incorporated in the envelope structure of the present invention, the tear strip further serves as a tamper indicator to provide evidence if someone other than the addressee attempts to open the closure envelope. This feature is further reinforced with the use of a non-release adhesive for the closure flap.

In addition to the above, the rear panel of the envelope structure is provided with a pair of generally vertically oriented perforated tear lines that are aligned to be substantially collinear with the outer edges of the side closure flaps of the envelope. These perforated tear lines provide an easy access to the interior of the envelope structure after removal of the tear strip from the top closure flap. Secondarily, the perforated lines also serve as tamper indicators to show if the integrity of the envelope has been disturbed by someone other than the addressee. The tamper evident feature is further reinforced by the use of a non-release adhesive for the side closure flaps.

It is therefore an object of the present invention to provide an envelope of the type described for tamper evident delivery of credit cards, debit cards and other items which require security.

It is also an object of the present invention to provide an easy access means to such an envelope where the easy access means serves as the tamper evident feature.

Other and more specific objects of the invention will become apparent from the following detailed description of the accompanying drawings which illustrate a preferred embodiment of the invention.

DETAILED DESCRIPTION

Figure 1:
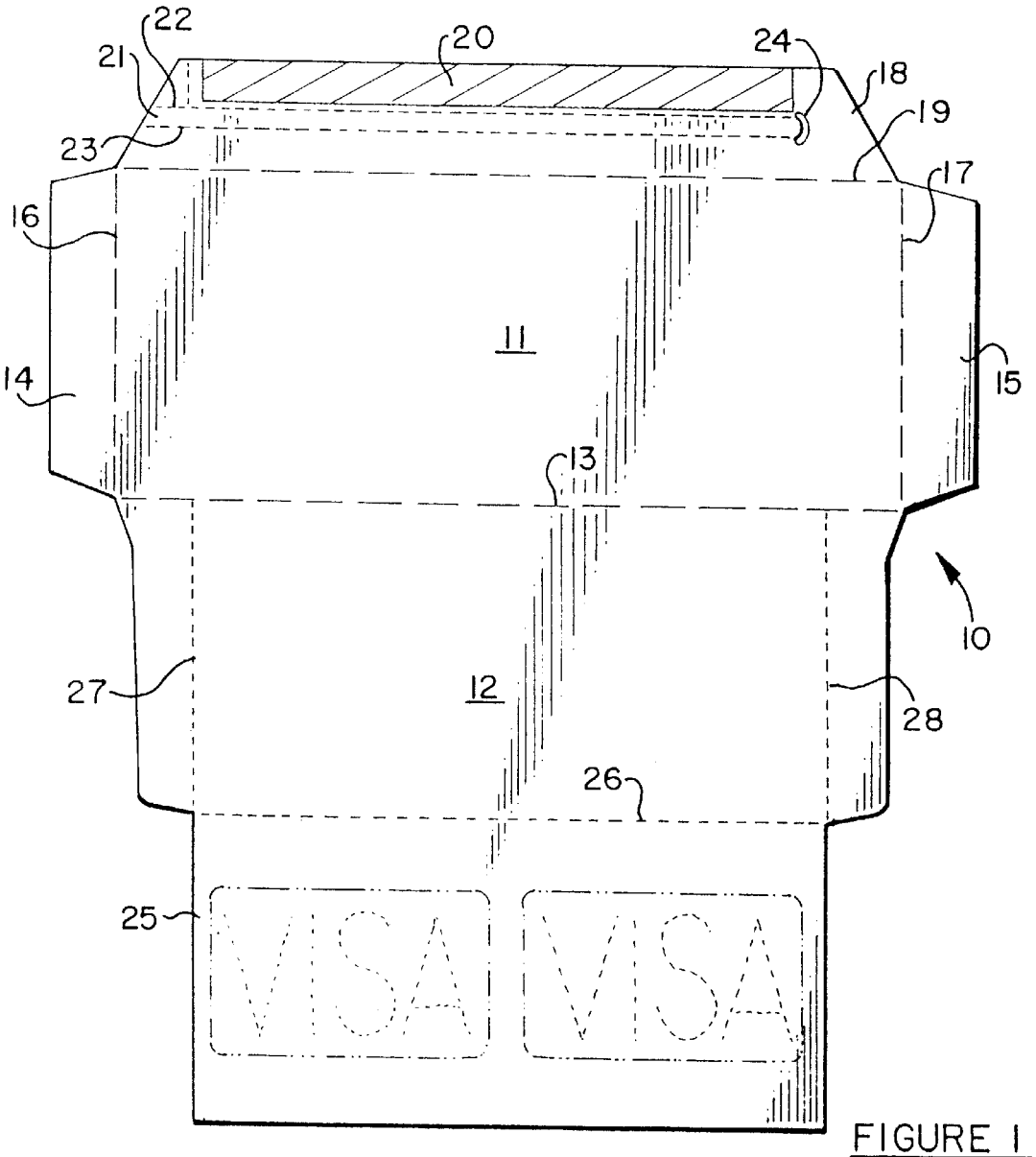
FIG. 1 is a plan view of a typical blank structure suitable for forming the envelope of the present invention.

Referring to the drawings, there is shown in FIG. 1 a typical blank structure for forming the envelope of the present invention. The blank 10 incudes a front panel 11 foldably attached to a rear panel 12 along a score line 13. The front panel also includes a pair of side closure flaps 14, 15 foldably attached to the side edges thereof along score lines 16, 17, although these flaps could just as readily be attached to the rear panel 12, and a top closure flap 18 foldably attached to the top edge of the front panel along a score line 19. Top closure flap 18 also includes an adhesive strip 20 and a tear strip 21 formed by a pair of generally parallel perforated lines 22, 23. Access to the tear strip 21 may be included at one end of the tear strip as shown by a cut out 24 in top closure flap 18.

Meanwhile, a bangtail flap 25 is shown as being attached to an edge of rear panel 12 along a perforated line 26. Perforated line 26 may, if desired, take the form of a scored fold line. The blank structure is completed with the addition of a pair of generally vertically oriented perforated tear lines 27, 28 in rear panel 12, although these perforated tear lines could, if desired, be arranged in a zig zag fashion or as converging/diverging. The tear lines 27, 28 are preferably located in panel 12 so as to lie slightly outboard from the side edges of the bangtail flap 25, when the envelope is formed, and likewise to be substantially collinear with the outer edges of the side closure flaps 14 and 15 when the envelope is formed. The perforated tear lines 27, 28 are designed to provide easy access to the envelope contents by the addressee, and by locating the tear lines as described above, they are highly likely to be broken by anyone tampering with the envelope, thus they also provide a tamper evident feature. The envelope is formed as shown in FIGS. 2 and 3.

The envelope of the present invention is described hereinafter as it would be used to send credit cards, debit cards or the like through the mail. The cards may be releasibly adhered to the inside of the bangtail flap 25 substantially as shown in FIG. 1. When used in this fashion, the bangtail flap 25 is folded over about perforated line 26 to sandwich the cards between the bangtail flap and the rear panel. Note in FIG. 2 that the perforated tear lines 27, 28 in rear panel 12 lie slightly outside the side edges of bangtail flap 25.

Figure 2:
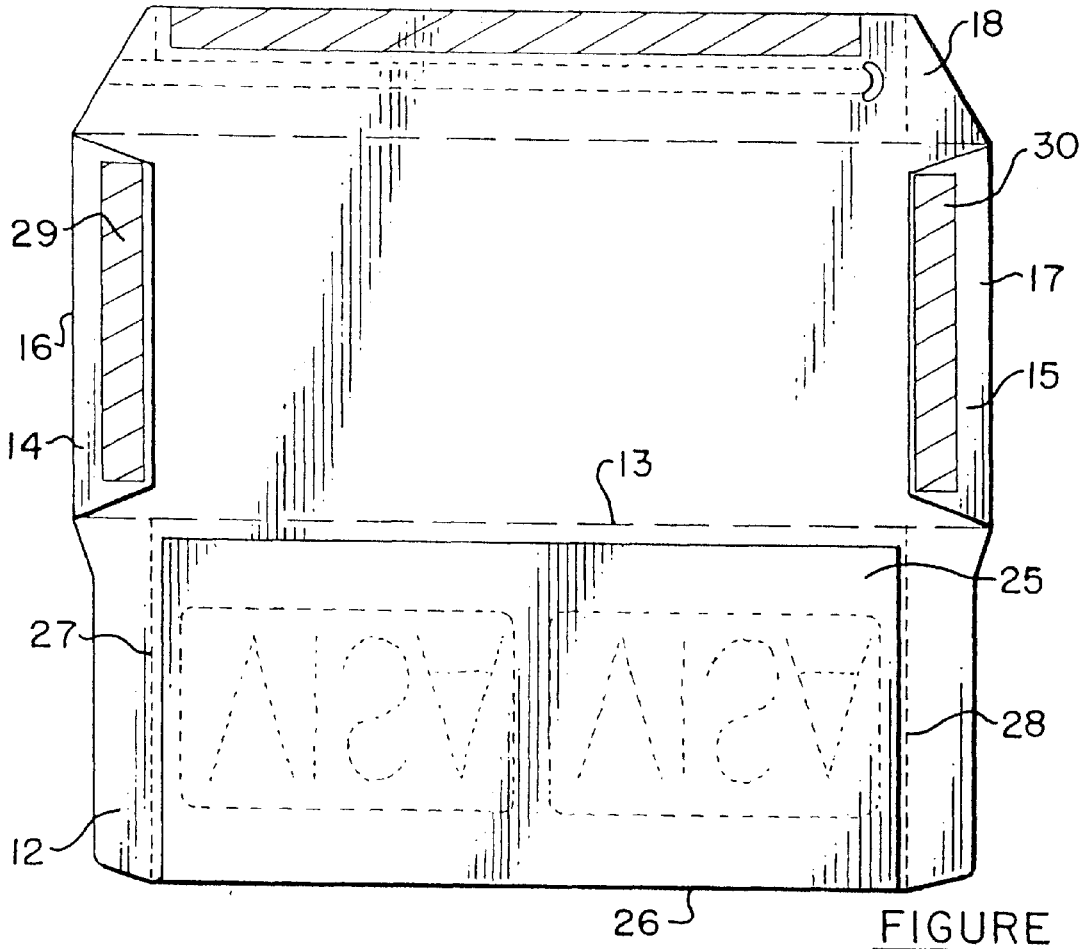
FIG. 2 is a plan view of the blank of FIG. 1 after the first folding step.

In addition, as shown in FIG. 2, at this stage of construction, the side closure flaps 14, 15 are folded over about score lines 16, 17 to lie adjacent front panel 11. In this position, strips of adhesive 29, 30 are applied to closure flaps 14, 15 as shown. Note also in FIG. 2 that the perforated tear lines 27, 28 in rear panel 12 are substantially collinear with the outer edges of the closure flaps 14, 15.

Figure 3:
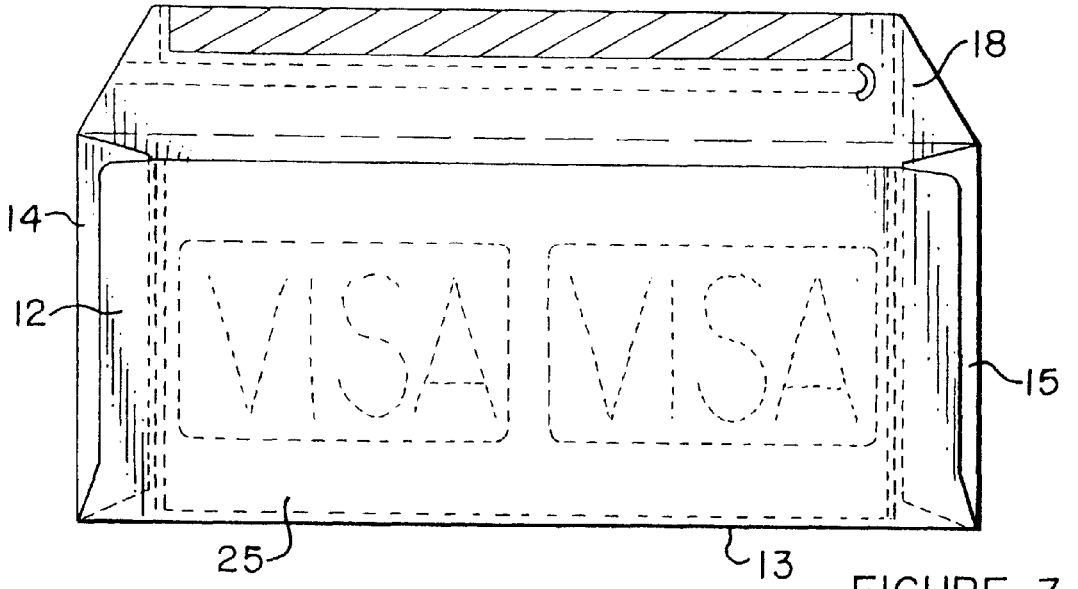
FIG. 3 illustrates the completed envelope construction prior to sealing; and, FIG. 4 shows the sealed envelope.

FIG. 3 shows the final stage of envelope construction wherein the combined rear panel 12 and bangtail flap 25 (shown in phantom lines) are folded over about score line 13 so as to adhere the outer edges of rear panel 12 to the side closure flaps 14, 15. This completes the construction of the envelope except for final sealing of the closure flap 18. At this point, the credit cards would be completely enclosed in the envelope structure between the bangtail flap 25 and the rear panel 12. This arrangement leaves an unrestricted space between the front panel 11 and the opposite side of the bangtail flap for insertion of additional material related to the mailing. If, instead of attaching the credit cards directly to the bangtail flap, the credit cards are attached to an insert included in the envelope, the credit cards will become sandwiched between the front panel 11 and the bangtail flap 25.

Figure 4:
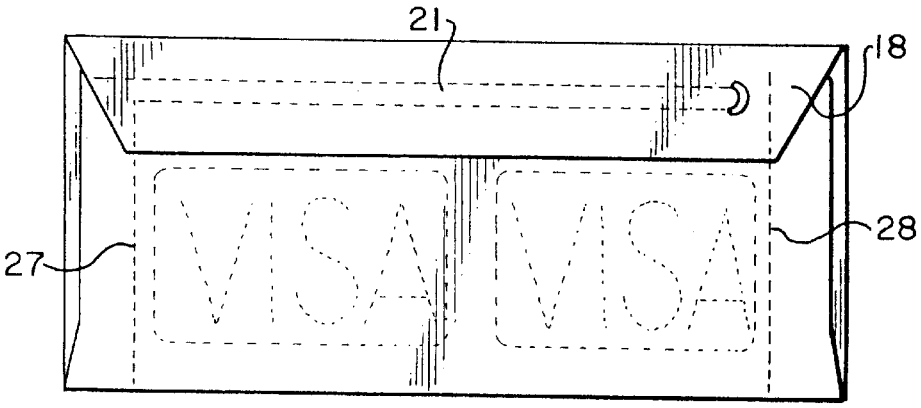

As shown in FIG. 4, upon receipt of the envelope, the recipient can access the contents by first removing the tear strip 21 from closure flap 18. After lifting the closure flap, the rear panel may be torn along perforated tear lines 27, 28 to reveal the bangtail flap 25. If the bangtail flap is attached to the rear panel along a perforated line 26, the entire flap can then be detached from the envelope.

It will be appreciated that the presence of the tear strip 21 in closure flap 18 provides a means to detect any tampering with the top closure flap 18 by someone other than the intended recipient. It will also be appreciated that the location of the perforated tear lines 27, 28 in rear panel 12 likewise provides a means for detecting any tampering with the side closure flaps 14, 15. In each case, where the proper adhesive is used, tampering with either the top closure flap or the side closure flaps will produce stresses that fracture these elements, thus indicating tampering.

It is also anticipated that the envelope structure disclosed could be used to securely mail invoices or billing statements, including documents, certificates or the like which could be printed directly on, or attached to, the bangtail flap. From the foregoing, it will be seen that a novel envelope structure has been described which provides both easy opening features and tamper evidence. Nevertheless, it will be obvious to one skilled in the art to make modifications and changes in the preferred embodiment disclosed. Accordingly, it is contemplated that various changes, modifications, arrangements and other details of the invention may be made without departing from the spirit of the invention as defined in the appended claims.

What is claimed is:

1. An envelope for secure mailing of credit cards or debit cards comprising a body portion formed from a front panel and rear panel with side closure flaps foldably connected to one of said front or rear panels and adhered to the other of said panels, a top closure flap foldably connected to one of said panels and adhered to the other of said panels, the improvement comprising a bangtail flap foldably connected to one of said panels and tucked inside the envelope body portion and an opening means formed in said rear panel for providing access to said bangtail flap, wherein the opening means for providing access to said bangtail flap comprises a pair of generally parallel perforated tear lines formed in said rear panel which extend generally from top to bottom thereof, wherein the perforated tear lines are arranged to lie slightly outboard of the edges of the bangtail flap and substantially collinear with the edges of said side closure flaps.

2. The envelope of claim 1 wherein a separate opening means is formed in the top closure flap by a pair of substantially parallel perforated tear lines which extend generally from side-to-side in said top closure flap.

3. The envelope of claim 2 wherein the perforated tear lines in said rear panel and the tear strip in said top closure flap each provide tamper evident indicators for said envelope.

* * * * *